United States Patent [19]

Kricheldorf

[11] Patent Number: 4,969,689

[45] Date of Patent: Nov. 13, 1990

[54] RETAINER FOR BABY'S SEAT

[76] Inventor: Mervin K. Kricheldorf, P. O. Box 740, Agassiz, British Columbia, Canada, VOM 1AO

[21] Appl. No.: 391,095

[22] Filed: Aug. 8, 1989

[51] Int. Cl.[5] ..... A47C 7/62; A47D 15/00

[52] U.S. Cl. ..... 297/467; 297/459

[58] Field of Search ..... 297/464, 467, 458, 459, 297/250, 435, 466, 423, 438, 439; 5/443

[56] References Cited

U.S. PATENT DOCUMENTS

| | | | |
|---|---|---|---|
| 2,652,883 | 9/1953 | Holtendorff | 297/467 X |
| 2,760,558 | 8/1956 | Ayers | 297/439 |
| 3,162,486 | 12/1964 | Emery | 297/439 |
| 3,216,738 | 11/1965 | Bockus | 297/467 X |
| 4,712,833 | 12/1987 | Swanson | 297/464 X |

FOREIGN PATENT DOCUMENTS

| | | | |
|---|---|---|---|
| 2615379 | 12/1988 | France | 297/485 |

*Primary Examiner*—Peter R. Brown

*Attorney, Agent, or Firm*—Christie, Parker & Hale

[57] ABSTRACT

A baby restraint device is disclosed which securely retains a baby on a seat. The device has a base with an elongate, shallow shape and an upstanding retainer positioned to define two wings of the base. The wings have holes for securely being screwed or bolted to the seat. Each wing also has a depression for receiving the undersides of the baby's thighs or bottom. The retainer has a concave shape toward the baby to retain the baby in the seat. The retainer and wings with the depressions securely fastened to the seat prevent twisting or sliding of the baby past either side of the retainer. The restraint device is so formed that it can be attached to a wall and the retainer can be used as a hook, or it can serve as a book end with the edge of the base and the tip of the retainer both engaging the side of a book.

5 Claims, 2 Drawing Sheets

RETAINER FOR BABY'S SEAT

FIELD OF THE INVENTION

The present invention relates to a baby restraint device for attachment to a seat for a baby and, more particularly, to a restraint device intended to prevent a baby from sliding forwardly from a seat.

BACKGROUND OF THE INVENTION

Various devices have in the past been proposed for use in conjunction with a baby'seat so as to provide a vertically extending retainer member adapted to fit between the legs of a baby for retaining the baby on its seat.

For example, in H. Hall U.S. Pat. No. 2,628,666, issued Feb. 17, 1953, there is disclosed an infants high chair having a vertical rod 10 which is pivotally secured to a tray holder so as to be adjustable into a downwardly pivoted position, in which the lower end of the rod projects through a vertical hole in the seat of the chair for restraining a seated infant from falling out through the space between the tray support and the chair seat.

R. K. Waldo U.S. Pat. No. 3,185, 521 issued May 25, 1965 discloses a safety guard for a child's high chair, which comprises a vertical inner post and a pair of vertical outer posts which are secured together and which depend from a tray forming a part of the high chair, the inner and outer posts being spaced apart to accommodate the baby's legs therebetween.

It has also been previously proposed to provide a retainer in the form of an upstanding post or other member which can be releasably secured to the top of the seat of an infant's chair for the same purpose, such devices being disclosed, for example, in E. M. Madsen U.S. Pat. No. 2,630,856 issued Mar. 10, 1953; E. M. Madsen U.S. Pat. No. 2,784,775 issued Mar. 12, 1957; De Alton L. Personett U.S. Pat. No. 2,858,882, issued Nov. 4, 1958 and L. E. Lowe U.S. Pat. No. 3,037,813 issued June 5, 1962. However, these prior devices lack any means for preventing the infant from twisting and sliding past the one side or the other of the retainer.

BRIEF SUMMARY OF THE INVENTION

It is an object of the present invention to provide a novel and improved baby restraint device which, in addition to a retainer arranged to fit between the legs of the infant, also has means for engaging the thighs and, if necessary, the bottom of the baby to prevent the baby from twisting and sliding forward laterally of the retainer member.

More particularly, according to the present invention a baby restraining device for attachment to a seat for retaining a baby on the seat comprises a base member for mounting on the seat, the base member having an elongate, shallow shape, and a retainer member upstanding from the base member so as to fit between the legs of the baby seated on the seat. The base member projects substantially from opposite sides of the retainer member to form a pair of wings, in which depressions are defined at opposite sides of the retainer member. The depressions are located at the rear top edges of the base member wings for partially receiving the baby's legs, and the wings served to counteract twisting and sliding of the baby past either side of the retainer member.

BRIEF DESCRIPTION OF THE DRAWINGS

Further features, advantages and objects of the present invention will appear from the following description thereof when taking in conjunction with the accompanying drawing, in which.

THE PREFERRED EMBODIMENT

Figure 1:
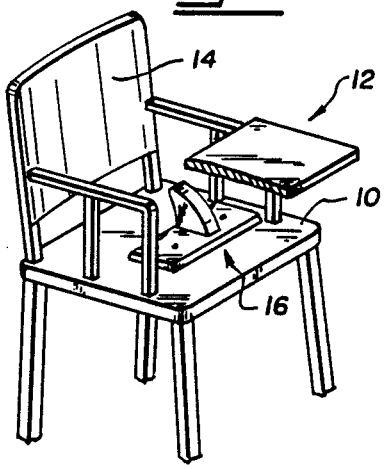
FIG. 1 shows a view in perspective of a baby's high chair provided with a baby restraint device according to the present invention.

In FIG. 1 of the drawings, there is illustrated a baby's high chair which has a conventional seat 10 and a tray, indicated generally by reference numeral 12, which is pivotally mounted on a chair back indicated generally by reference numeral 14.

The baby high chair of FIG. 1, as thus far described, is of conventional construction.

According to the present invention, a baby restraint device indicated generally by reference numeral 16 is provided for attachment to the top surface of the seat 10 of the high chair.

Figure 2:
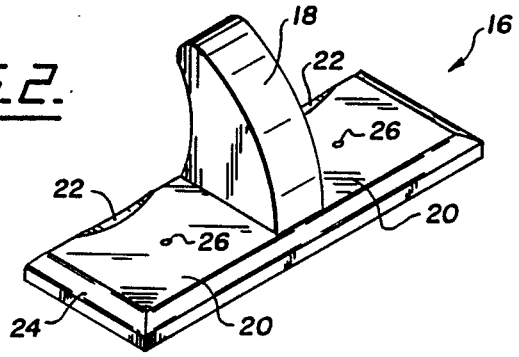
FIG. 2 shows a view in perspective of the baby restraint device of FIG. 1.

As can be seen in FIG. 2, the baby restraint device 16 has, at its midpoint, a vertically upwardly extending retainer member 18, which is intended to fit between the legs of a baby (not shown) when the baby is seated on the seat 10.

The retainer member 18 is upstanding from a base member which comprises a pair of wings 20 projecting laterally from opposite sides of the retainer member 18 at the lower end of the retainer member 18.

As will apparent, the base member formed by these two wings 20 has a shallow, elongate, rectangular shape and extends transversely of the high chair seat 10 at a location spaced rearwardly from the front edge of the high chair seat 10.

The wings 20 have generally flat upper surfaces which are interrupted, at the rear top edges of the wings 20, by upwardly concave, curved depressions or recesses 22. These recesses 22 serve to accommodate the thighs of the baby seated on the high chair. In order to avoid discomfort to the baby, the top edges of the wings 20 are formed with a bevel 24 extending around the periphery of the base of the restraint device.

The baby restraint device is conveniently secured to the high chair seat 10 by wood screws or bolts inserted through holes 26, penetrating the wings 20 into and the high chair seat 10. Thus, the device is positively and securely connected to the seat 10.

The device can be used with or without the tray 12, and has no moving parts and requires no adjustment.

The retainer member 18, when viewed in side elevation, has a rearwardly concave, hook-shape. As a result of this shape, the retainer member 18 can serve the function of retaining the baby on the high chair seat 10 and, upon removal of the baby restraint device from the high chair seat 10, can alternatively serve as a wall hook.

Figure 3:
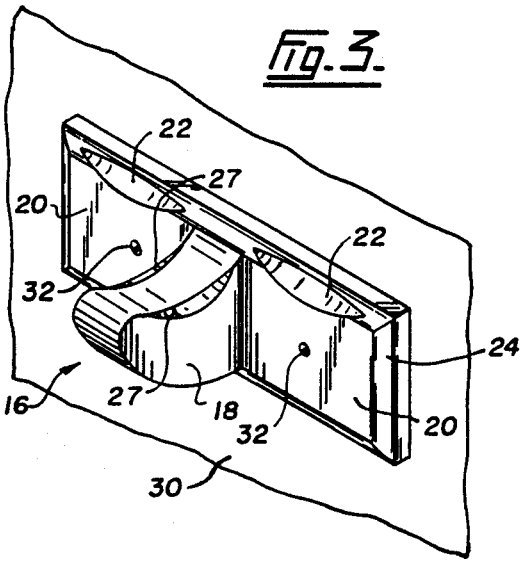
FIG. 3 shows a view in perspective of the baby restraint device of FIGS. 1 and 2 in use as a wall hook.

Thus, as shown in FIG. 3, the baby restraint device may be secured to a wall 30, by means of screws 32 inserted through the holes 26 in the wings 20. The retainer member 18 then projects forwardly from the wall 30 so as to form a hook, for example for clothes or for other articles.

When the retainer member 18 is in use for retaining a baby on the chair seat 10, a concave recess 27 at the rear side of the retainer member 18 relieves pressure on the baby's crotch area which could otherwise cause discomfort and automatically gently returns the baby to a proper sitting position at the rear of the chair when the baby lifts itself in the chair.

The base member, formed by the wings 20, and the retainer member 18, provides a strong structure which is comfortable for the infant in use.

Figure 4:
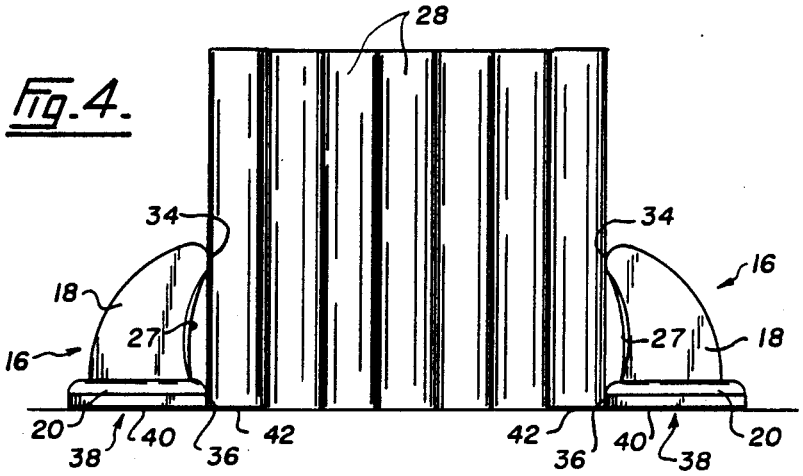
FIG. 4 shows a view in front elevation of the pair of the devices of FIG. 2 in use as book-ends.
Figure 5:
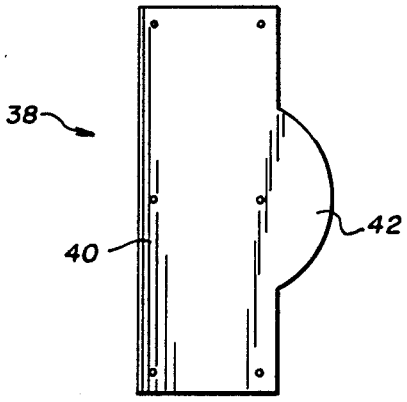
FIG. 5 shows a plan view of a plate which can be screwed to the underside of the device of FIG. 2 when the device is to be used as a book-end.

As shown in FIG. 4, a pair of the restraint devices 16 may be used as book-ends, for retaining a plurality of books 28 in an upright condition. For that purpose, the retainer member 18 is so shaped that a rearwardly extending tip 34 of the retainer member 18 is located in vertical alignment with a rear edge 36 of the base member formed by the wings 20.

Also, a metal plate 38, having a major rectangular portion 40 corresponding in size and shape to the base member and a convexly curved projecting portion 42 located at one side of the rectangular portion 40 and projecting rearwardly beyond the rear edge 36 and beneath the books 28, is secured by screws (not shown) to the underside of each base member. The plates 38 add weight to the book-ends and counteract tipping but may if desired be omitted.

Thus, as the child grows, the present device, when no longer useful in a high chair, can still be used as a wall hook or a book-end though the entire life of the child.

I claim:

1. A baby restraint device for attachment to a seat for retaining a baby on the seat, said device comprising:

a base member for mounting on the seat, said base member having an elongate, shallow shape;

a retainer member upstanding from said base member so as to fit between the legs of the baby when the baby is seated on the seat;

said base member projecting substantially from opposite sides of said retainer member to form a pair of wings of said device; and means forming a pair of depressions in respective ones of said wings of said base member at opposite sides. of said retainer member, said depressions being located at rear top edges of said base member wings for partially engaging at least one of the undersides of the baby's thighs and bottom, so that twisting and sliding of the baby past either side of the retainer member is opposed by said base member wings.

2. A baby restraint device as claimed in claim 1, wherein said retainer member is concavely shaped substantially as a rearwardly-curving hook, whereby said device is utilizable, on removal from the seat, as a wall hook.

3. A baby restraint device as claimed in claim 2, wherein the retainer has an upper end shaped and positioned with respect to a rear edge of the base member wings for engaging together with the rear edge a side of a book, whereby the device is utilizable, on removal from the seat, as a book end.

4. A baby restraint device as claimed in claim 1, wherein the base member has a hole formed in each of the wings for being securely screwed or bolted to the seat.

5. A baby restraint device as claimed in claim 1, wherein the retainer has an upper end shaped and positioned with respect to a rear edge of the base member wings for engaging together with the rear edge a side of a book, whereby the device is utilizable, on removal from the seat, as a book end.

* * * * *